United States Patent [19]

Nemit

[11] 4,164,742

[45] Aug. 14, 1979

[54] MULTIBEAM SLOT ARRAY

[75] Inventor: Jeffrey T. Nemit, Canoga Park, Calif.

[73] Assignee: International Telephone and Telegraph Corporation, New York, N.Y.

[21] Appl. No.: 865,614

[22] Filed: Dec. 29, 1977

[51] Int. Cl.[2] ..... H01Q 13/10

[52] U.S. Cl. ..... 343/768; 343/771

[58] Field of Search ..... 343/768, 770, 771, 853, 343/854

[56] References Cited

U.S. PATENT DOCUMENTS

| | | | |
|---|---|---|---|
| 3,281,851 | 10/1966 | Goebels | 343/768 |
| 3,570,007 | 3/1971 | Whitehead | 343/771 |

*Primary Examiner*—Eli Lieberman

*Attorney, Agent, or Firm*—William T. O'Neil

[57] ABSTRACT

A slotted-waveguide linear array in which a pattern of slots in a narrow wall of a first waveguide forms the aperture of the array. A second waveguide runs parallel to the first guide, the other narrow wall of the first waveguide being a common wall with the second waveguide. The pattern of coupling holes through this common wall couples energy between the waveguides.

A feed arrangement, preferably including a 180° hybrid, has two of its ports connected one each to the first and second waveguides, the difference port, when driven, providing 180° phase feed of the two waveguides so that the presence of the second waveguide is substantially nil. Thus, a single beam is formed as if the second waveguide were not present. The feed also provides for excitation of the waveguides through a mutual hybrid in-phase relationship when the sum port of the hybrid is driven, in which case the beam is angularly separated from the original beam.

9 Claims, 8 Drawing Figures

MULTIBEAM SLOT ARRAY

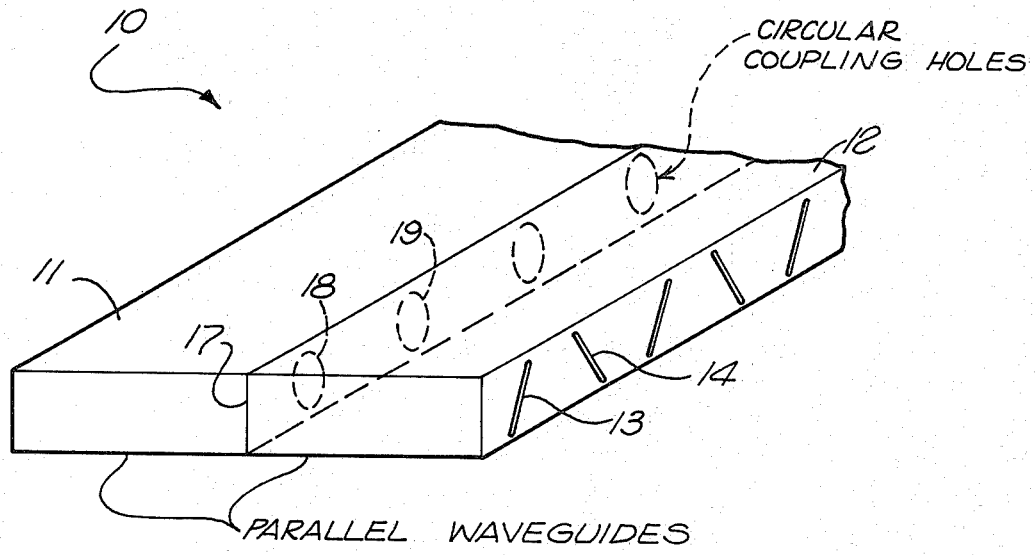
FIG. 1 MULTIBEAM SLOT ARRAY
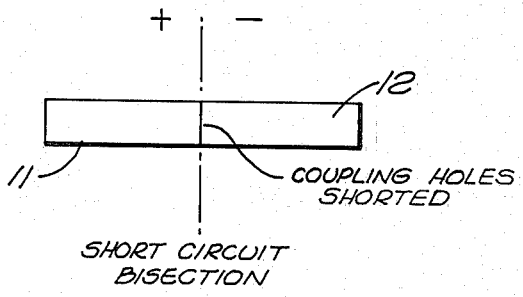
FIG. 2
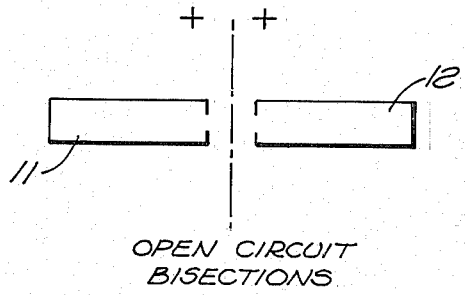
FIG. 3
FIG. 4
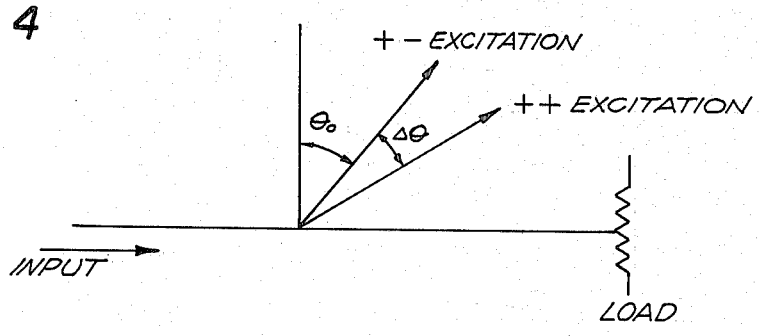

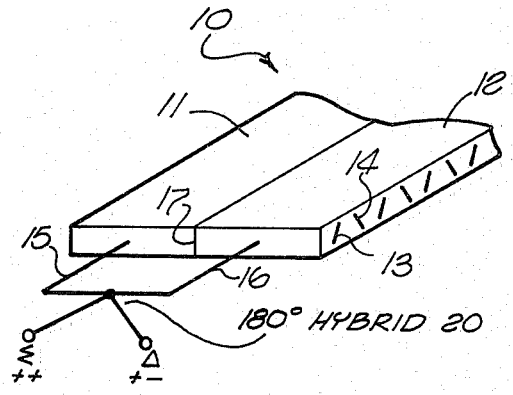
FIG. 5a
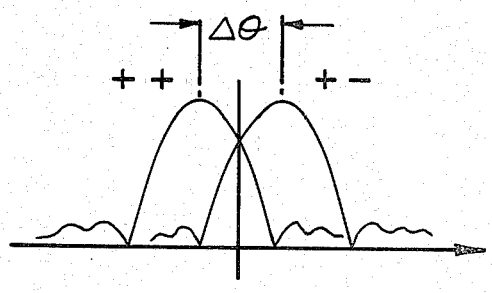
FIG. 5b
FIG. 6a
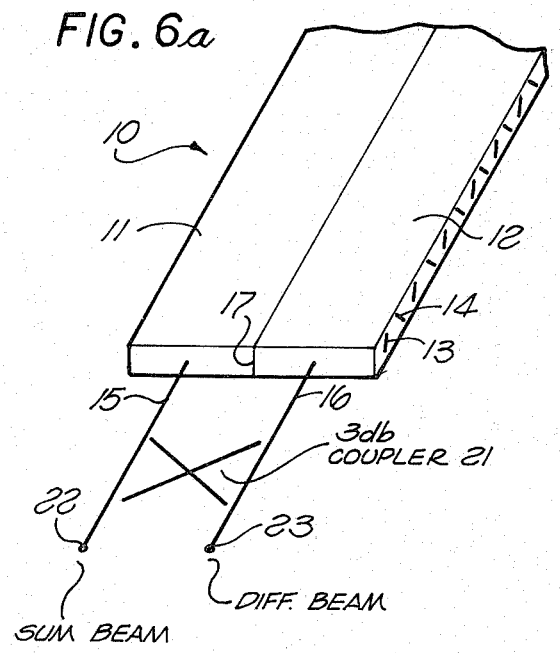
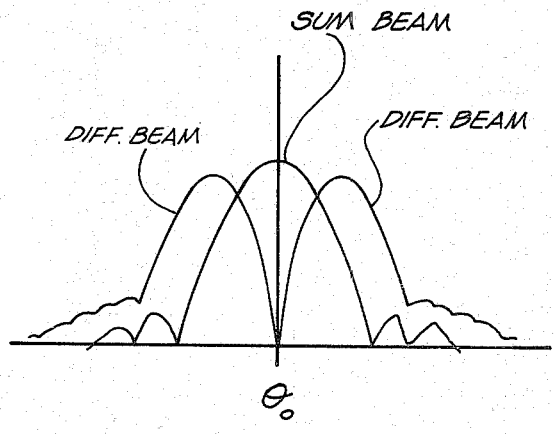
FIG. 6b

MULTIBEAM SLOT ARRAY

BACKGROUND OF THE INVENTION

The invention relates to beam-forming antenna arrays generally and, more specifically, to slotted-waveguide type arrays as commonly employed in radar systems.

Slotted-waveguide antenna arrays are well known in the art. The slot patterns used, most often in the narrow wall of a rectangular waveguide, vary according to the design objectives. The angle of incline of the slots at their spacing are dictated according to well known criteria based on bandwidths, grating lobe considerations, and polarization objectives.

U.S. Pat. No. 3,740,751 shows a slotted waveguide array in which the slots are in pairs for the accomplishment of a specific purpose therein described.

Slot arrays have been recognized as an attractive element for antenna systems since they allow the efficient distribution and radiation of electromagnetic fields with precise control of the aperture illumination and, therefore, the far-field patterns. The prior art slotted waveguide array system, however, is limited to the formation of one beam in space at a single excitation frequency in the plane parallel to the array length. This can be a major limitation for radar applications where monopulse or simulraneous multiple beams are required in the plane of the slot array.

Recognizing the existence of slotted waveguide arrays in the prior art and the limitations thereof, the manner in which the present invention permits the formation of a pair of beams will be evident as this description proceeds.

SUMMARY

The invention involves a novel concept according to which it it possible to develop simultaneous dual beams from a slotted array aperture. The technique consists of joining two waveguides at a common wall with coupling holes between them. The waveguides are essentially parallel and of at least approximately the same length.

By feeding the two waveguides appropriately, the phase velocity along the array can be changed which results in a shift in the beam position. This property is employed in accordance with the present invention to form two different contemporaneous beams for amplitude or phase monopulse radar systems. As the description proceeds, it will be seen that when the waveguides are fed out of phase by 180°, the common wall coupling apertures have essentially no effect; however, when the waveguides are fed in-phase, the common wall is open circuit bisection. For circular coupling holes, this produces inductive loading at the sidewall, thus decreasing the phase velocity and shifting the beam. The details of the feed for providing the two simultaneous beams will be understood as this description proceeds.

BRIEF DESCRIPTION OF THE DRAWINGS

FIG. 1 depicts a pair of parallel waveguides with circular coupling holes through their common wall and antenna element slots in the narrow wall of one of the guides.

FIG. 2 depicts short circuit bisection at the common wall of FIG. 1 in accordance with the first feed condition.

FIG. 3 depicts an open circuit bisection at the common wall of FIG. 1 according to a corresponding feed arrangement.

FIG. 4 is a beam angle diagram depicting the angular separation between first and second beams.

FIG. 5*a* is a schematic block diagram including a feed arrangement for dual-beam generation according to the invention.

FIG. 5*b* is a graphic representation of the two beams produced by the arrangement in FIG. 5*a*.

FIG. 6*a* is a schematic block diagram according to the invention for producing a monopulse-type, sum and difference beam patterns according to FIG. 6*b*.

DETAIL DESCRIPTION

The novel concept according to the invention makes it possible to develop simultaneous multiple beams from a slot array aperture. As will be seen in FIG. 1, the basic technique comprises the joining of two waveguides at a common (narrow) wall with coupling holes between them. By appropriate feed to the two waveguides, the phase velocity along the array can be changed which produces a shift in the beam position. This property is exploited to form discrete beams for amplitude or phase monopulse radar applications.

Consider the case in which the incremental loss (per unit length of waveguides) due to radiation is relatively small and the first and second waveguides 11 and 12 are fed out of phase by 180°. The common wall 17 may then be considered bisected by short circuit as illustrated in FIG. 2. With such a short circuit at the common wall, the coupling apertures, typically 18 and 19 in FIG. 1, at a short circuit plane and do not effect the phase velocity at either waveguide 10 or 12 of the combination depicted generally at 10. The phase velocity, and therefore the the beam position, is at the same angle at with the unperturbed waveguide, or as at waveguide 12 operated independently without the coupling holes but with its conventional radiator slots of which 13 and 14 are typical. This angle is identified as $\theta_0$ on FIG. 4 corresponding to the relative 180° excitation contemplated in FIG. 2. For illustration purposes, the symbol "+" followed by a "−" indicated relative 180° excitation phase relationship between waveguides 11 and 12.

Now consider the waveguides to be fed in phase. FIG. 3 illustrates that the common wall is now equivalent to an open circuit bisection. For circular coupling holes, such as 18 and 19, etc., this will appear as inductive loading at the common sidewall which has the effect of decreasing the phase velocity within the guides and shifting the beam from $\theta_0$ toward the load illustrated in FIG. 4 with a beam shift between beams of approximately one-half beamwidth, simultaneous beams are monopulse scan, as well as different independent beams can be synthesized by appropriate feed arrangements for the two waveguide inputs.

On FIG. 4, the second angular vector illustrates the in-phase excitation situation just described; i.e., that of FIG. 3 diagramatically. This second angular beam representing vector being spaced by $\Delta\theta$ from $\theta_0$.

Considering FIGS. 5*a* and 5*b* at the same time, the generation of the two angularly separated beams according to FIG. 5*b* correponding to the ++ and +− excitations contemplated in FIG. 4 will be described. In FIG. 5*a*, the overall dual, common wall, waveguide arrangement 10 is illustrated with the same waveguides 11 and 12 as contemplated in FIG. 1. Radiator slots 13 and 14, etc., are shown, and it is to be assumed that the coupling slots, specifically 18 and 19, etc., are extant in the common wall 17.

A 180° hybrid 20 has sum and difference port and also ports 15 and 16 which are connected to waveguides 11 and 12, respectively, as indicated. By feeding the sum and/or Δ ports of FIG. 5*a* the corresponding beam of FIG. 5*b* can be generated. Similarly, separate circuitry responsive to these Σ and Δ ports can produce simultaneous operation on these two angularly separated beams.

Referring now to FIG. 6*a*, the same basic common wall arrangement of waveguides 11 and 12 with radiating slots and coupling holes according to FIG. 1 is commonplace. In this instance, however, a 3 db coupler 21 is employed in the feed arrangement. The 3 db coupler 21 produces a relative excitation at the inputs of waveguides 11 and 12 separated by 90°. This arrangement as depicted in FIG. 6*b* is the typical monopulse beam configuration providing a sum pattern and a difference pattern, in this case between two discrete beam positions, for producing the difference or interferometer beam pattern, both symmetrically about $\theta_0+(\Delta\theta/2)$.

The design criteria for placing the coupling apertures in the common waveguide wall 17 will be understood by those skilled in this art. Circular coupling holes have been suggested, however, a design could be implement with slots, square holes, or other types of holes. In general, the amount of coupling provided by these coupling apertures determines the spread between the two simultaneous beams inherently formed by the arrangement.

The dual parallel common wall waveguide configuration of 10 comprising waveguides 11 and 12, sharing common wall 17, is to be understood to be constructed of ordinary waveguide conductive materials well known in the art. The feed transitions at 15 and 17, of course, depends on the nature of the implementation of the 180° hybrid of FIG. 5*a* or the 3 db coupler of FIG. 6*a*. If these are implemented in the waveguide medium, this coupling is substantially direct. If hybrid 20 or coupler 21 were implemented in stripline (for example, well known stripline-to-waveguide transitions) would be required, these being a matter of design readily undertaken by those skilled in this art. Well-known monopulse-type radar circuitry would be connected to ports 22 and 23 of FIG. 6*a*. In case of FIG. 5*a*, a waveguide switch could be installed to switch back and forth between Σ and Δ ports of hybrid 20, providing a type of time-sharing between the two beams of FIG. 5*b*. Of course, these Σ and Δ ports might be independently connected to appropriate radar circuitry for essentially simultaneous operations on the two angularly separated beams of FIG. 5*b*.

The effect of the asymmetry introduced by the fact that waveguide 12 contains conventional slots and waveguide 11 does not, is relatively minor, the phase velocity discrepancy resulting therefrom being correctable empirically or rigorously by application of design principles well understood in this art.

Other applications, as well as modifications and variations of the implementation described, will suggest themselves to those skilled in this art, once the principles of the invention are fully appreciated. Accordingly, it it not intended that the drawings or this description should be considered as limiting the scope of the invention. The drawings and this description are to be regarded as typical and illustrative only.

What is claimed is:

1. A directive antenna arrangement comprising:

a slotted first rectangular waveguide forming a linear array to produce a first beam at a first angle in a first plane;

a second waveguide parallel to said first waveguide and having one common narrow wall with said first waveguide;

feed means for separately coupling between said first and second waveguides and first and second external ports, respectively, said feed including means for simultaneously providing at least one choice of relative feed phases pairs consisting of a first phase at said first port and substantially 180° phase at said second port;

and energy coupling means through said common wall for coupling energy between said first and second waveguides at a plurality of predetermined points substantially over the lengths of said waveguides, said antenna arrangement thereby being capable of generating said first and second beams simultaneously at angularly separated positions.

2. Apparatus according to claim 1 further defined in that the degree of coupling provided by said energy coupling means determines said angular separation of said beams.

3. Apparatus according to claim 1 in which said energy coupling means comprises a plurality of substantially uniformly spaced discrete openings through said common wall.

4. Apparatus according to claim 2 in which said energy coupling means comprises a plurality of substantially uniformly spaced discrete openings through said common wall.

5. Apparatus according to claim 1 in which phase switching means are included, whereby said feed means may be selectively adapted to feed said waveguides in phase to produce a single beam from said first waveguide operating as said linear array, and alternatively to feed said waveguides in said phases separated 180° to provide said angularly separated first and second beams.

6. Apparatus according to claim 2 in which phase switching means are included, whereby said feed means may be selectively adapted to feed said waveguides in phase to produce a single beam from said first waveguide operating as said linear array, and alternatively to feed said waveguides in said phases separated 180° to provide said angularly separated first and second beams.

7. Apparatus according to claim 3 in which phase switching means are included, whereby said feed means may be selectively adapted to feed said waveguides in phase to produce a single beam from said first waveguide operating as said linear array, and alternatively to feed said waveguides in said phases separated 180° to provide said angularly separated first and second beams.

8. Apparatus according to claim 3 in which said discrete openings extend substantially over the length of said common wall.

9. Apparatus according to claim 5 in which said phase shifting means comprises a 180° hybrid, and in which a radio frequency switching device is also included and is connected to select between in-phase and 180° relative phase feeds at said first and second ports.

* * * * *